US007374664B2

(12) United States Patent
Powers

(10) Patent No.: US 7,374,664 B2
(45) Date of Patent: May 20, 2008

(54) OLEFIN PRODUCTION UTILIZING WHOLE CRUDE OIL FEEDSTOCK

(75) Inventor: Donald H. Powers, Houston, TX (US)

(73) Assignee: Equistar Chemicals, LP, Houston, TX (US)

( * ) Notice: Subject to any disclaimer, the term of this patent is extended or adjusted under 35 U.S.C. 154(b) by 477 days.

(21) Appl. No.: 11/219,166

(22) Filed: Sep. 2, 2005

(65) Prior Publication Data

US 2007/0055087 A1 Mar. 8, 2007

(51) Int. Cl.
*C07C 4/04* (2006.01)
*C10G 9/36* (2006.01)

(52) U.S. Cl. ..... 208/130; 585/648; 585/652

(58) Field of Classification Search ..... 208/130; 585/652, 648

See application file for complete search history.

(56) References Cited

U.S. PATENT DOCUMENTS

| | | | | |
|---|---|---|---|---|
| 5,817,226 | A | 10/1998 | Lenglet | 208/130 |
| 6,632,351 | B1 | 10/2003 | Ngan et al. | 208/132 |
| 6,743,961 | B2 | 6/2004 | Powers | 585/648 |
| 6,979,757 | B2 * | 12/2005 | Powers | 585/648 |
| 7,090,765 | B2 | 8/2006 | Spicer et al. | 208/130 |
| 7,097,758 | B2 | 8/2006 | Stell et al. | 208/48 |
| 7,138,047 | B2 | 11/2006 | Stell et al. | 208/130 |
| 2005/0209495 | A1 | 9/2005 | McCoy et al. | 585/648 |
| 2005/0261530 | A1 | 11/2005 | Stell et al. | 585/648 |
| 2005/0261531 | A1 | 11/2005 | Stell et al. | 585/648 |
| 2005/0261532 | A1 | 11/2005 | Stell et al. | 585/648 |
| 2005/0261533 | A1 | 11/2005 | Stell et al. | 585/648 |
| 2005/0261534 | A1 | 11/2005 | Stell et al. | 585/648 |
| 2005/0261535 | A1 | 11/2005 | Beattie et al. | 585/648 |
| 2005/0261536 | A1 | 11/2005 | Stell et al. | 585/648 |
| 2005/0261537 | A1 | 11/2005 | Stell et al. | 585/648 |
| 2005/0261538 | A1 | 11/2005 | Stell | 585/648 |
| 2007/0004952 | A1 | 1/2007 | McCoy et al. | 585/648 |

FOREIGN PATENT DOCUMENTS

WO PCT/US2006/031616 5/2007

OTHER PUBLICATIONS

Co-pending U.S. Appl. No. 10,244,792, filed Sep. 16, 2002.
Co-pending U.S. Appl. No. 10/616,839, filed Jul. 10, 2003.

* cited by examiner

*Primary Examiner*—Tam M. Nguyen
(74) *Attorney, Agent, or Firm*—Roderick W. MacDonald

(57) ABSTRACT

A method for utilizing whole crude oil as a feedstock for the pyrolysis furnace of an olefin production plant wherein the feedstock is subjected to vaporization conditions until substantially vaporized with minimal mild cracking but leaving some remaining liquid from the feedstock, the vapors thus formed being subjected to severe cracking in the radiant section of the furnace, and the remaining liquid from the feedstock being mixed with at least one quenching oil.

16 Claims, 2 Drawing Sheets

OLEFIN PRODUCTION UTILIZING WHOLE CRUDE OIL FEEDSTOCK

BACKGROUND OF INVENTION

1. Field of Invention

This invention relates to the formation of olefins by thermal cracking of whole crude oil. More particularly, this invention relates to utilizing whole crude oil as a feedstock for an olefin production plant that employs a hydrocarbon cracking process such as steam cracking in a pyrolysis furnace.

2. Description of the Prior Art

Thermal cracking of hydrocarbons is a petrochemical process that is widely used to produce olefins such as ethylene, propylene, butenes, butadiene, and aromatics such as benzene, toluene, and xylenes.

Basically, a hydrocarbon feedstock such as naphtha, gas oil or other fractions of whole crude oil that are produced by distilling or otherwise fractionating whole crude oil, is mixed with steam which serves as a diluent to keep the hydrocarbon molecules separated. The steam/hydrocarbon mixture is preheated to from about 900 to about 1,000 degrees Fahrenheit (° F. or F), and then enters the reaction zone where it is very quickly heated to a severe hydrocarbon cracking temperature in the range of from about 1,450 to about 1,550 F.

This process is carried out in a pyrolysis furnace (steam cracker) at pressures in the reaction zone ranging from about 10 to about 30 psig. Pyrolysis furnaces have internally thereof a convection section and a radiant section. Preheating is accomplished in the convection section, while severe cracking occurs in the radiant section.

After severe cracking, the effluent from the pyrolysis furnace contains gaseous hydrocarbons of great variety, e.g., from one to thirty-five carbon atoms per molecule. These gaseous hydrocarbons can be saturated, monounsaturated, and polyunsaturated, and can be aliphatic, alicyclics, and/or aromatic. The cracked gas also contains significant amounts of molecular hydrogen (hydrogen).

Thus, conventional steam cracking, as carried out in a commercial olefin production plant, employs a fraction of whole crude and totally vaporizes that fraction while thermally cracking same. The cracked product can contain, for example, about 1 weight percent (wt. %) hydrogen, about 10 wt. % methane, about 25 wt. % ethylene, and about 17 wt. % propylene, all wt. % being based on the total weight of said product, with the remainder consisting mostly of other hydrocarbon molecules having from 4 to 35 carbon atoms per molecule.

The cracked product is then further processed in the olefin production plant to produce, as products of the plant, various separate individual streams of high purity such as hydrogen, ethylene, propylene, mixed hydrocarbons having four carbon atoms per molecule, fuel oil, and pyrolysis gasoline. Each separate individual stream aforesaid is a valuable commercial product in its own right. Thus, an olefin production plant currently takes a part (fraction) of a whole crude stream and generates a plurality of separate, valuable products therefrom.

The starting material from which a feedstock for a conventional olefin production plant, as described above, normally has first been subjected to substantial, expensive processing before it reaches that plant. Normally, whole crude is distilled or otherwise fractionated into a plurality of fractions such as gasoline, kerosene, naphtha, gas oil (vacuum or atmospheric) and the like, including a high boiling residuum. Thereafter any of these fractions, other than the residuum, can be passed to an olefin production plant as the feedstock for that plant.

It would be desirable to be able to forego the capital and operating cost of a refinery distillation unit (whole crude processing unit) that processes crude oil to generate a crude oil fraction that serves as feedstock for conventional olefin producing plants. However, the prior art, until recently, taught away from even hydrocarbon cuts (fractions) that have too broad a boiling range distribution. For example, see U.S. Pat. No. 5,817,226 to Lenglet.

Recently, U.S. Pat. No. 6,743,961 issued to Donald H. Powers. This patent relates to cracking whole crude oil by employing a vaporization/mild cracking zone that contains packing. This zone is operated in a manner such that the liquid phase of the whole crude that has not already been vaporized is held in that zone until cracking/vaporization of the more tenacious hydrocarbon liquid components is maximized. This allows only a minimum of solid residue formation which residue remains behind as a deposit on the packing. This residue is later burned off the packing by conventional steam air decoking, ideally during the normal furnace decoking cycle, see column 7, lines 50-58 of that patent. Thus, the second zone 9 of that patent serves as a trap for components, including hydrocarbonaceous materials, of the crude oil feed that cannot be cracked or vaporized under the conditions employed in the process, see column 8, lines 60-64 of that patent.

U.S. patent application Ser. No. 10/244,792, filed Sep. 16, 2002, having common inventorship and assignee with U.S. Pat. No. 6,743,961, is directed to the process disclosed in that patent but which employs a mildly acidic cracking catalyst to drive the overall function of the vaporization/mild cracking unit more toward the mild cracking end of the vaporization (without prior mild cracking)—mild cracking (followed by vaporization) spectrum.

U.S. patent application Ser. No. 10/616,839, filed Jul. 10, 2003, having common inventorship and assignee with U.S. Pat. No. 6,743,961, is directed to the process disclosed in that patent but which removes at least part of the liquid hydrocarbons remaining in the vaporization/mild cracking unit that are not yet vaporized or mildly cracked. These liquid hydrocarbon components of the crude oil feed are drawn from near the bottom of that unit and passed to a separate controlled cavitation device to provide additional cracking energy for those tenacious hydrocarbon components that have previously resisted vaporization and mild cracking. Thus, that invention also seeks to drive the overall process in the vaporization/mild cracking unit more toward the mild cracking end of the vaporization—mild cracking spectrum aforesaid.

SUMMARY OF THE INVENTION

In accordance with this invention there is provided a process for utilizing whole crude oil as the feedstock for an olefin producing plant which maximizes the vaporization function and minimizes, if not eliminates, the mild cracking function aforesaid, and thereby drives the overall process in the vaporization unit of this invention strongly toward the vaporization end of the spectrum aforesaid.

Pursuant to this invention, whole crude oil is preheated, as in a conventional olefin production plant (olefin plant), to produce a mixture of hydrocarbon vapor and liquid from the crude oil feedstock with little or no coke formation. The vaporous hydrocarbon is then separated from the remaining liquid, and the vapor passed on to a severe cracking operation. The liquid hydrocarbon remaining is subjected to conditions that favor vaporization over mild cracking by introducing a quenching oil into the unit and withdrawing from that unit a liquid residuum composed of quenching oil and remaining liquid hydrocarbons from the crude oil feed.

DETAILED DESCRIPTION OF THE INVENTION

Figure 1:
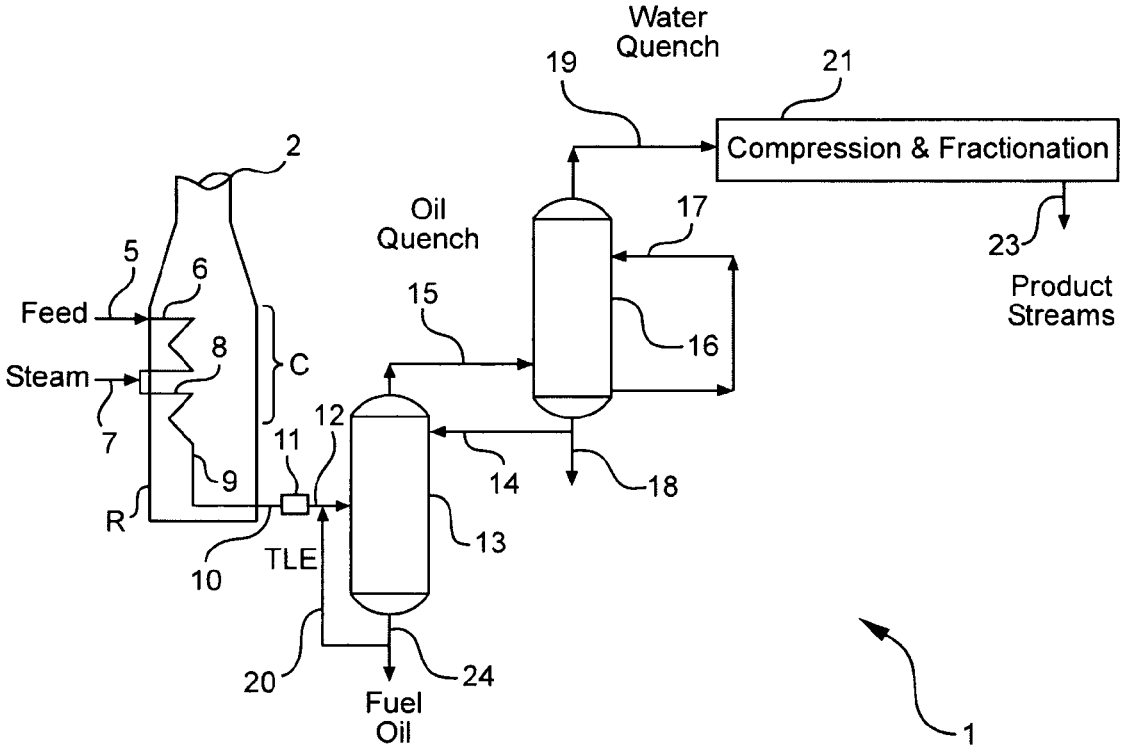
FIG. 1 shows a simplified flow sheet for a typical hydrocarbon cracking plant.

The term "whole crude oil" as used in this invention means crude oil as it issues from a wellhead except for any treatment such crude oil may receive to render it acceptable for transport to a crude oil refinery and/or conventional distillation in such a refinery. This treatment would include such steps as desalting. It is crude oil suitable for distillation or other fractionation in a refinery, but which has not undergone any such distillation or fractionation. It could include, but does not necessarily always include, non-boiling entities such as asphaltenes or tar. As such, it is difficult if not impossible to provide a boiling range for whole crude oil. Accordingly, the whole crude oil used as an initial feed for an olefin plant pursuant to this invention could be one or more crude oils straight from an oil field pipeline and/or conventional crude oil storage facility, as availability dictates, without any prior fractionation thereof.

The terms "hydrocarbon" and "hydrocarbons" as used in this invention do not mean materials strictly or only containing hydrogen atoms and carbon atoms. Such terms mean materials that are hydrocarbonaceous in nature in that they primarily or essentially are composed of hydrogen and carbon atoms, but can contain other elements such as oxygen, sulfur, nitrogen, metals, inorganic salts, asphaltenes, and the like, even in significant amounts.

The terms "gas" or "gases" as used in this invention mean one or more gases in an essentially vaporous state, for example, steam alone, a mixture of steam and hydrocarbon vapor, and the like.

The term "coke" as used in this invention means any high molecular weight carbonaceous solid, and includes compounds formed from the condensation of polynuclear aromatics.

An olefin producing plant useful with this invention would include a pyrolysis (cracking) furnace for initially receiving and cracking the whole crude oil feed. Pyrolysis furnaces for steam cracking of hydrocarbons heat by means of convection and radiation, and comprise a series of preheating, circulation, and cracking tubes, usually bundles of such tubes, for preheating, transporting, and cracking the hydrocarbon feed. The high cracking heat is supplied by burners disposed in the radiant section (sometimes called "radiation section") of the furnace. The waste gas from these burners is circulated through the convection section of the furnace to provide the heat necessary for preheating the incoming hydrocarbon feed. The convection and radiant sections of the furnace are joined at the "cross-over," and the tubes referred to hereinabove carry the hydrocarbon feed from the interior of one section to the interior of the next.

Cracking furnaces are designed for rapid heating in the radiant section starting at the radiant tube (coil) inlet where reaction velocity constants are low because of low temperature. Most of the heat transferred simply raises the hydrocarbons from the inlet temperature to the reaction temperature. In the middle of the coil, the rate of temperature rise is lower but the cracking rates are appreciable. At the coil outlet, the rate of temperature rise increases somewhat but not as rapidly as at the inlet. The rate of disappearance of the reactant is the product of its reaction velocity constant times its localized concentration. At the end of the coil, reactant concentration is low and additional cracking can be obtained by increasing the process gas temperature.

Steam dilution of the feed hydrocarbon lowers the hydrocarbon partial pressure, enhances olefin formation, and reduces any tendency toward coke formation in the radiant tubes.

Cracking furnaces typically have rectangular fireboxes with upright tubes centrally located between radiant refractory walls. The tubes are supported from their top.

Firing of the radiant section is accomplished with wall or floor mounted burners or a combination of both using gaseous or combined gaseous/liquid fuels. Fireboxes are typically under slight negative pressure, most often with upward flow of flue gas. Flue gas flow into the convection section is established by at least one of natural draft or induced draft fans.

Radiant coils are usually hung in a single plane down the center of the fire box. They can be nested in a single plane or placed parallel in a staggered, double-row tube arrangement. Heat transfer from the burners to the radiant tubes occurs largely by radiation, hence the thermo "radiant section," where the hydrocarbons are heated to from about 1,450° F. to about 1,550° F. and thereby subjected to severe cracking.

The radiant coil is, therefore, a fired tubular chemical reactor. Hydrocarbon feed to the furnace is preheated to from about 900° F. to about 1,000° F. in the convection section by convectional heating from the flue gas from the radiant section, steam dilution of the feed in the convection section, or the like. After preheating, in a conventional commercial furnace, the feed is ready for entry into the radiant section.

In a typical furnace, the convection section can contain multiple zones. For example, the feed can be initially preheated in a first upper zone, boiler feed water heated in a second zone, mixed feed and steam heated in a third zone, steam superheated in a fourth zone, and the final feed/steam mixture preheated to completion in the bottom, fifth zone. The number of zones and their functions can vary considerably. Thus, pyrolysis furnaces can be complex and variable structures.

The cracked gaseous hydrocarbons leaving the radiant section are rapidly reduced in temperature to prevent destruction of the cracking pattern. Cooling of the cracked gases before further processing of same downstream in the olefin production plant recovers a large amount of energy as high pressure steam for re-use in the furnace and/or olefin plant. This is often accomplished with the use of transfer-line exchangers that are well known in the art.

Radiant coil designers strive for short residence time, high temperature and low hydrocarbon partial pressure. Coil lengths and diameters are determined by the feed rate per coil, coil metallurgy in respect of temperature capability, and the rate of coke deposition in the coil. Coils range from a single, small diameter tube with low feed rate and many tube coils per furnace to long, large-diameter tubes with high feed rate and fewer coils per furnace. Longer coils can consist of lengths of tubing connected with u-turn bends. Various combinations of tubes can be employed. For example, four narrow tubes in parallel can feed two larger diameter tubes, also in parallel, which then feed a still larger tube connected in series. Accordingly, coil lengths, diameters, and arrangements in series and/or parallel flow can vary widely from furnace to furnace. Furnaces, because of proprietary features in their design, are often referred to by way of their manufacturer. This invention is applicable to any pyrolysis furnace, including, but not limited to, those manufactured by Lummus, M. W. Kellog & Co., Mitsubishi, Stone & Webster Engineering Corp., KTI Corp., Linde-Selas, and the like.

Downstream processing of the cracked hydrocarbons issuing from the furnace varies considerably, and particularly based on whether the initial hydrocarbon feed was a gas or a liquid. Since this invention only uses as a feed whole crude oil which is a liquid, downstream processing herein will be described for a liquid fed olefin plant. Downstream processing of cracked gaseous hydrocarbons from liquid feedstock, naphtha through gas oil for the prior art, and whole crude oil for this invention, is more complex than for gaseous feedstock because of the heavier hydrocarbon components present in the feedstock.

With a liquid hydrocarbon feedstock downstream processing, although it can vary from plant to plant, typically employs an oil quench of the furnace effluent after heat exchange of same in, for example, a transfer-line exchanger as aforesaid. Thereafter, the cracked hydrocarbon stream is subjected to primary fractionation to remove heavy liquids such as fuel oil, followed by compression of uncondensed hydrocarbons, and acid gas and water removal therefrom. Various desired products are then individually separated, e.g., ethylene, propylene, a mixture of hydrocarbons having four carbon atoms per molecule, fuel oil, pyrolysis gasoline, and a high purity hydrogen stream.

In accordance with this invention, a process is provided which utilizes whole crude oil liquid (has not been subjected to fractionation, distillation, and the like) as the primary (initial) feedstock for the olefin plant pyrolysis furnace. By so doing, this invention eliminates the need for costly distillation of the whole crude oil into various fractions, e.g., from naphtha to gas oils, to serve as the primary feedstock for a furnace as is primarily done by the prior art as first described hereinabove.

As alluded to above, using a liquid hydrocarbon primary feedstock is more complex than using a gaseous hydrocarbon primary feedstock because of the heavier components that are present in the liquid that are not present in the gas. This is much more so the case when using whole crude oil as a primary feedstock as opposed to using liquid naphtha or gas oils as the primary feed. With whole crude oil there are more hydrocarbon components present that are normally liquids and whose natural thermodynamic tendency is to stay in that state. Liquid feeds require thermal energy to heat the liquid to its vaporization temperature, which can be quite high for heavier components, plus the latent heat of vaporization for such components.

As mentioned above, the preheated hydrocarbon stream passed to the radiant section is required to be in the gaseous state for cracking purposes, and therein lays the challenge for using whole crude oil as a primary feed to a furnace. It is also highly desirable to keep the aforesaid heavier components out of the radiation section and even the higher temperature portions of the convection section, because if they contact the inside wall of the radiant coil, they can cause the formation of undesired coke in that coil. By this invention, even though whole crude oil is used as a primary feed, the production of excessive amounts of coke is avoided. This is contrary to the preponderance of the prior art which teaches that feeding whole crude oil directly to a conventional steam furnace is not feasible.

By this invention, the foregoing problems with using whole crude oil as a primary feed to a furnace are avoided, and complete vaporization of the hydrocarbon stream that is passed into the radiant section of the furnace is achieved by employing primarily a vaporization function, as opposed to a combined vaporization/mild cracking function, wherein mild cracking is not a material goal of the process. The vaporization step of this invention can involve slight amounts of mild cracking or no mild cracking depending on the materials employed, e.g., crude oil feed and quenching oil (defined hereinafter), but mild cracking is not a goal of this invention. Mild cracking to a slight degree is just unavoidable in some circumstances with materials that contain hydrocarbonaceous components.

This invention can be carried out using a self-contained vaporization facility that operates separately from and independently of the convection and radiant sections, and can be employed as (1) an integral section of the furnace, e.g., inside the furnace in or near the convection section but upstream of the radiant section and/or (2) outside the furnace itself but in fluid communication with the furnace. When employed outside the furnace, whole crude oil primary feed is preheated in the convection section of the furnace, passed out of the convection section and the furnace to a standalone vaporization facility. The vaporous hydrocarbon product of this standalone facility is then passed back into the furnace to enter the radiant section thereof. Preheating can be carried out other than in the convection section of the furnace if desired or in any combination inside and/or outside the furnace and still be within the scope of this invention.

The vaporization unit of this invention receives the whole crude oil primary feed that has been preheated, for example, to from about 500° F. to about 750° F., preferably from about 550° F. to about 650° F. This is a lower temperature range than what is required for complete vaporization of the feed, and is part of the novel features of this invention. This lower preheat temperature range helps avoid fouling and coke production in the preheat section when operated in accordance with this invention. Such preheating preferably, though not necessarily, takes place in the convection section of the same furnace for which such whole crude is the primary feed.

Thus, the first zone in the vaporization operation step of this invention employs vapor/liquid separation wherein vaporous hydrocarbons and other gases, if any, in the preheated feed stream are separated from those components that remain liquid after preheating. The aforesaid gases are removed from the vapor/liquid separation section and passed on to the radiant section of the furnace.

Vapor/liquid separation in this first, e.g., upper, zone knocks out liquid in any conventional manner, numerous ways and means of which are well known and obvious in the art. Suitable devices for liquid vapor/liquid separation include liquid knock out vessels with tangential vapor entry, centrifugal separators, conventional cyclone separators, schoepentoeters, vane droplet separators, and the like.

Figure 2:
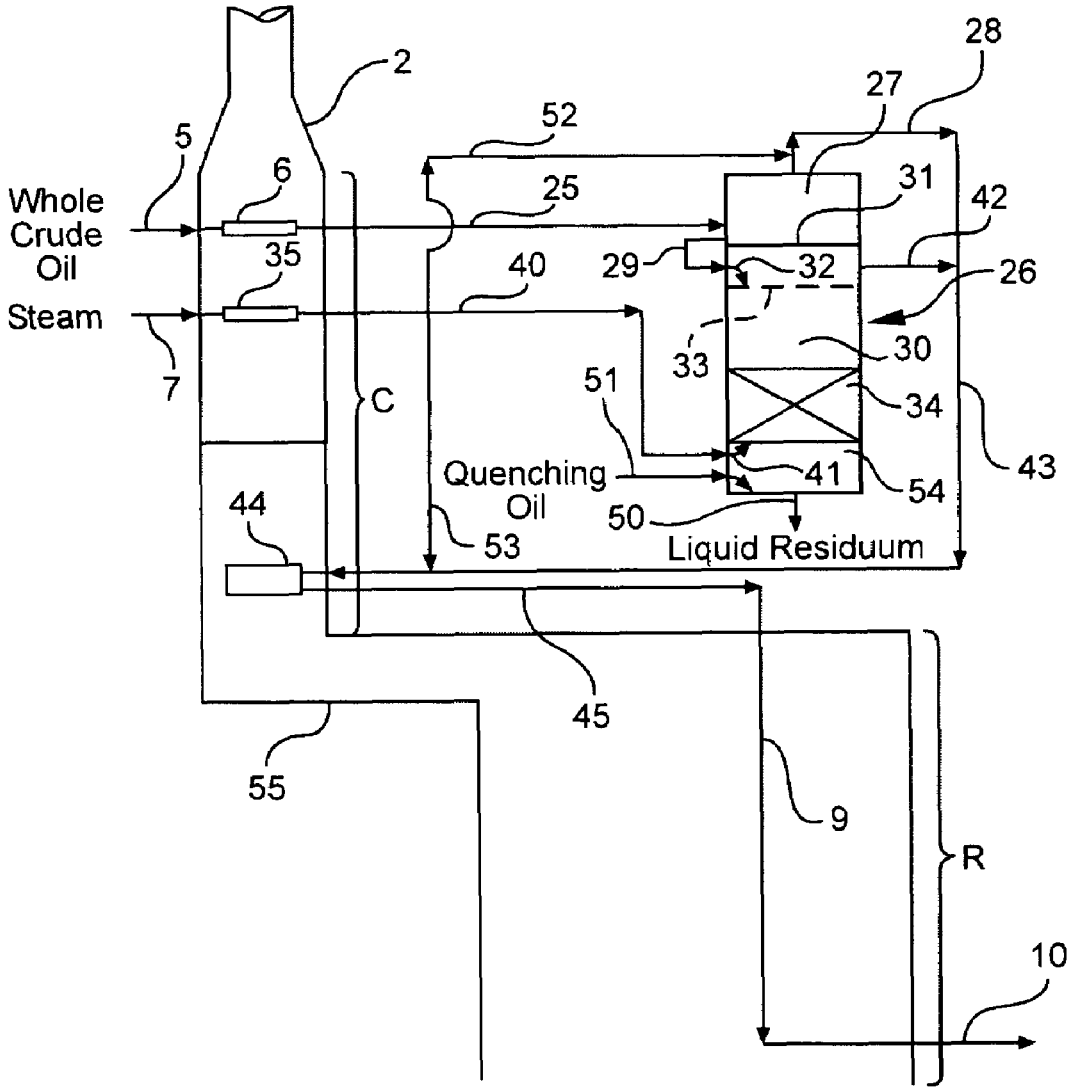
FIG. 2 shows one embodiment within this invention, this embodiment employing a standalone vaporization unit.

Liquid thus separated from the aforesaid vapors moves into a second, e.g., lower, zone. This can be accomplished by external piping as shown in FIG. 2 hereinafter. Alternatively this can be accomplished internally of the vaporization unit. The liquid entering and traveling along the length of this second zone meets oncoming, e.g., rising, steam. This liquid, absent the removed gases, receives the full impact of the oncoming steam's thermal energy and diluting effect.

This second zone can carry at least one liquid distribution device such as a perforated plate(s), trough distributor, dual flow tray(s), chimney tray(s), spray nozzle(s), and the like.

This second zone can also carry in a portion thereof one or more conventional distillation tower packing materials for promoting intimate mixing of liquid and vapor in the second zone.

As the liquid hydrocarbon travels (falls) through this second zone, it is vaporized in substantial part by the high energy steam with which it comes into contact. This enables the hydrocarbon components that are more difficult to vaporize to continue to fall and be subjected to higher and higher steam to liquid hydrocarbon ratios and temperatures to enable them to be vaporized by both the energy of the steam and the decreased liquid hydrocarbon partial pressure with increased steam partial pressure. In addition, with certain crude oil feed compositions, the steam may also provide energy for some slight amount of mild thermal cracking to reduce the molecular weight of various materials in the liquid thereby enabling them to be vaporized. However, because of the novel steps employed in this invention, if mild cracking takes place, it does so in minor, even insignificant amounts. For certain light whole crude oils used as primary feed in this invention, essentially only vaporization occurs with little or no mild cracking taking place.

By this invention, and contrary to the prior art, vaporization, essentially without mild cracking of liquid hydrocarbon in the vaporization unit of this invention, is maximized and mild cracking of liquid components minimized, if not eliminated. This is achieved by introducing quenching oil into the vaporization unit and withdrawing on a regular basis from that unit a mixture of quenching oil and liquid hydrocarbon from the crude feed. In this manner, with the appropriate combination of crude oil and quenching oil, the desired amount of hydrocarbon vapor for feeding the radiant section of the furnace can be generated by the vaporization function alone. With crude oils and/or quenching liquids of other and different compositions some slight amount of mild cracking could take place, but even in this situation the vast majority of desired hydrocarbon vapor will be generated by the vaporization function alone.

FIG. 1 shows a typical cracking operation (plant) 1 wherein furnace 2 has an upper convection section C and a lower radiant section R joined by a crossover (see FIG. 2). Feed 5 is to be cracked in furnace 2, but, before cracking, to ensure essentially complete vaporization, it is first preheated in zone 6, then mixed with dilution steam 7, and the resulting mixture heated further in zone 8 which is in a hotter area of section C than is zone 6. The resulting vapor mixture is then passed into radiant section R and distributed to one or more radiant coils 9. The cracked gas product of coil 9 is collected and passed by way of line 10 to a plurality of transfer line exchangers 11 (TLE in FIG. 1) where the cracked gas product is cooled to the extent that the thermal cracking function is essentially terminated. The cracked gas product is further cooled by injection of recycled cooled quench oil 20 immediately downstream of TLE's 11. The quench oil and gas mixture passes via line 12 to oil quench tower 13. In tower 13 it is contacted with a hydrocarbonaceous liquid quench material such as pyrolysis gasoline from line 14 to further cool the cracked gas product as well as condense and recover additional fuel oil product. Part of product 24 is recycled, after some additional cooling (not shown), via line 20 into line 12. Cracked gas product is removed from tower 13 via line 15 and passed to water quench tower 16 wherein it is contacted with recycled and cooled water 17 that is recovered from a lower portion of tower 16. Water 17 condenses out a liquid hydrocarbon fraction in tower 16 that is, in part, employed as liquid quench material 14, and, in part, removed via line 18 for other processing elsewhere. The part of quench oil fraction 24 that is not passed into line 20 is removed as fuel oil and processed elsewhere.

The thus processed cracked gas product is removed from tower 16 and passed via line 19 to compression and fractionation facility 21 wherein individual product streams aforesaid are recovered as products of plant 1, such individual product streams being collectively represented by way of line 23.

FIG. 2 shows one embodiment of the application of the process of this invention to furnace 2 of FIG. 1. FIG. 2 is very diagrammatic for sake of simplicity and brevity since, as discussed above, actual furnaces are complex structures. In FIG. 2, furnace 2 is shown to have primary feed stream 5 entering preheat section 6. Feed 1 may be mixed with diluting steam (not shown) for reasons described hereinabove before it enters section 6 and/or interiorly of section 6. Section 6 is the preheat section of a furnace. Feed 5 passes through section 6 and when heated into the desired temperature range aforesaid leaves section 6 by way of line 25. In a conventional olefin plant, the preheated feed would be mixed with dilution steam and then would pass from section 6, e.g., the convection section C of the furnace, into section 8 of FIG. 1, and then into the radiant section R of furnace 2. However, pursuant to this invention, the preheated feed (a mixture composed principally of hydrocarbon liquid and hydrocarbon vapor from feed 5) passes instead by way of line 25, at a temperature of from about 500° F. to about 750° F., into standalone vaporization unit 26 that is, in this embodiment, physically located outside of furnace 2. Unit 26 is, however, in fluid communication with furnace 2. The preheated feed initially enters upper first zone 27 of unit 26 wherein the gaseous components present are separated from the accompanying still liquid components.

Unit 26 is a vaporization unit that is one component of the novel features of this invention. Unit 26 is not found in conjunction with conventional cracking furnaces. Unit 26 receives whole crude oil from furnace 2 via line 25, and heats it further to from about 650° F. to about 1,100° F. to achieve primarily (predominantly) vaporization of at least a significant portion of the primary feed that remains in the liquid state. Gases that are associated with the preheated whole crude oil feed as received by unit 26 are removed from zone 27 by way of line 28. Thus, line 28 carries away essentially all the hydrocarbon vapors that are present in zone 27. Liquid present in zone 27 is removed therefrom via line 29 and passed into the upper interior of lower zone 30. Zones 27 and 30, in this embodiment, are separated from fluid communication with one another by an impermeable wall 31, which can be a solid tray. Line 29 represents external fluid down flow communication between zones 27 and 30. In lieu thereof, or in addition thereto, zones 27 and 30 can have internal fluid communication there between by modifying wall 31 to be at least in part liquid permeable by use of one or more tray(s) designed to allow liquid to pass down into the interior of zone 30 and vapor up into the interior of zone 27. For example, instead of an impermeable wall (or solid tray) 31, a chimney tray could be used in which case vapor carried by line 42 would instead pass through the chimney tray and leave unit 26 via line 28, and liquid 32 would pass internally within unit 26 down into section 30 instead of externally of unit 26 via line 29. In this internal down flow case, distributor 33 becomes optional.

By whatever way liquid is removed from zone 27 to zone 30, that liquid moves downwardly as shown by arrow 32, and thus encounters at least one liquid distribution device 33 as described hereinabove. Device 33 evenly distributes liquid across the transverse cross section of unit 26 so that the liquid will flow uniformly across the width of the tower into contact with packing 34. In this invention, packing 34 is devoid of materials such as catalyst that will promote mild cracking of hydrocarbons.

Dilution steam 7 passes through superheat zone 35, and then, via line 40 into a lower portion 54 of zone 30 below packing 34 wherein it rises as shown by arrow 41 into contact with packing 34. In packing 34 liquid 32 and steam 41 intimately mix with one another thus vaporizing a substantial amount of liquid 32. This newly formed vapor, along with dilution steam 41, is removed from zone 30 via line 42 and added to the vapor in line 28 to form a combined hydrocarbon vapor product in line 43. Stream 42 can contain essentially hydrocarbon vapor from feed 5 and steam. However, depending on the chemical composition of quenching oil 51, it can contain either no components of such quenching oil or small to significant amounts of any lighter hydrocarbon components originally present in oil 51. For example, with heavy quenching oil such as heavy fuel oil, essentially no components will vaporize and end up in stream 42, but with lighter quenching oil such as kerosene, crude oil(s), or natural gas condensate, significant amounts of lighter components of such oils can end up in stream 42.

Stream 42 thus represents a substantial part of feed stream 5 plus dilution steam 41, less a liquid residuum from feed 5 that is present in stream 50. Stream 43 is passed through a mixed feed preheat zone 44 in a hotter (lower) section of convection zone C to further increase the temperature of all materials present, and then via cross over line 45 into radiant coil 9 in section R. Line 45 can be internal or external of furnace conduit 55.

Stream 7 can be employed entirely in zone 30, or a part thereof can be employed in either line 28 (via line 52) or line 43 (via line 53), or both to aid in the prevention of liquid condensation in lines 28 and 43.

In section R the vaporous feed from line 45 which contains numerous varying hydrocarbon components is subjected to severe cracking conditions as aforesaid.

The cracked product leaves section R by way of line 10 for further processing in the remainder of the olefin plant downstream of furnace 2 as shown in FIG. 1.

Section 30 of unit 26 provides surface area for contacting liquid 32 with hot gas or gases, e.g., steam, 41. The counter current flow of liquid and gas within section 30 enables the heaviest (highest boiling point) liquids to be contacted at the highest hot gas to hydrocarbon ratio and with the highest temperature gas at the same time. This creates a most efficient device and operation for vaporization of the heaviest residue of the crude oil feedstock 5 thereby allowing for very high utilization of such crude oil as vaporous feed 45 for severe cracking section R.

By this invention, such liquids are primarily vaporized, with little or no use of the mild thermal cracking function in zone 30. This is accomplished by removing liquid in a continuous or at least semi-continuous or periodic manner from bottom section 54 of zone 30 via line 50, and the introduction of quenching oil 51 into such bottom liquid. Thus, a liquid residuum 50 can be formed that is at least initially composed of a mixture of such bottom liquid and quenching oil 51.

Quenching oil 51 can be, but is not necessarily, the same material as that which is conventionally referred to in a cracking plant as quench oil, i.e., oil 24 in FIG. 1. Oil 51 is essentially all hydrocarbonaceous and normally liquid at ambient conditions of temperature and pressure. It can contain a vast array of hydrocarbon molecules, and, therefore, is difficult, if not impossible, to characterize by way of its chemical composition. However, this is not necessary to inform the art because it can be characterized as a hydrocarbonaceous mixture that is liquid at ambient conditions of temperature and pressure. Thus, a wide variety of known materials can be employed, such as cracking plant quench oil 24 of FIG. 1, crude oil feed 5 of FIG. 1, natural gas condensate, diesel oil, fuel oil, gas oil, kerosene, and the like.

Oil 51 is introduced into zone 30 at a temperature substantially lower than the liquid remaining from feed 5 that is present in lower section 54 of zone 30. The temperature of oil 51 can be sufficiently lower than that of such liquid as to at least reduce, and preferably eliminate, any coke forming reactions that may be taking place (present) in such liquid at the temperature prevailing in section 54 of zone 30, particularly that portion which is below the lowest point in such section at which steam 41 is introduced. Such a temperature can vary widely, but will generally be less than about 800 F, preferably less than about 700 F. The pressure of oil 51 as introduced into zone 30 can be that sufficient to is inject that oil into the interior of that zone, e.g., from slightly over atmospheric up to about 100 psig.

Oil 51 may or may not contain lighter hydrocarbon fractions that flash or otherwise vaporize at the conditions prevailing in zone 30 below the lowest point at which stream 41 is introduced into section 54. If oil 51 is a natural gas condensate, for example, components thereof may vaporize and reach line 42. Such vaporization, particularly by flashing, can help cool the liquid with which oil 51 is mixed thereby aiding in the cooling of such liquid as discussed hereinabove. If oil 51 contains components that can vaporize under the conditions of zone 30 and end up in lines 42 and 43, such components should be suitable and operable as cracking feed for coil 9. Oil 51, as to its initial composition, can be chosen so that it does or does not vaporize in essentially its entirety, in section 54 of zone 30. Oil 51 can have a viscosity significantly (measurably) lower than that of the liquid hydrocarbon with which it is mixed in section 54 of zone 30 so that the fraction of oil 51 that remains in liquid residuum mixture 50 additionally serves to reduce the overall viscosity of mixture 50 thereby aiding the handling of mixture 50 downstream of this process.

Thus, by the use of quenching oil 51 of this invention and the removal of residuum 50, the overall operation of unit 26 can be driven toward the vaporization function to the exclusion or essential exclusion of the mild cracking function. This allows for a broader compositional scope of whole crude feed materials 5 that can be employed in the process. Also, this allows for heavy hydrocarbon heating with hot gas briefly, as opposed to the prior art of heating with a hot metal surface, followed by rapid quenching, thereby avoiding the formation of coke and undesirable coke fouling and plugging of the system. Further, coke in stream 50 is desirably avoided, because the less coke present, the higher the petrochemical quality and value of that stream.

Oil 51 not only can be employed in a manner to cool the bottoms liquid in section 54 and reduce coke formation in zone 30 and line 50, but, with a careful choice of chemical composition for oil 51, this cooling effect can be augmented by the flashing of lighter components from oil 51 under the operating conditions of section 54. These flashed materials can also contribute beneficially to the amount of feed provided to the cracking process in coils 9 thereby enhancing the productivity of the cracking plant as a whole.

Thus, in the illustrative embodiment of FIG. 2, separated liquid hydrocarbon 29 falls downwardly from zone 27 into lower, second zone 30, and is vaporized in part in zone 30, without depending on mild cracking. These gaseous hydrocarbons make their way out of unit 26 by way of line 42 due to the influence of hot gas, e.g., steam, 41 rising through zone 30 after being introduced into a lower portion, e.g., bottom half or one-quarter, of zone 30 (section 54) by way of line 40.

Feed 5 can enter furnace 2 at a temperature of from about ambient up to about 300 F at a pressure from slightly above atmospheric up to about 100 psig (hereafter "atmospheric to 100 psig"). Preheated feed 5 can enter zone 27 via line 25 at a temperature of from about 500 to about 750 F, preferably from about 600 to about 650 F at a pressure of from atmospheric to 100 psig.

Stream 28 can be essentially all hydrocarbon vapor formed from feed 5 and is at a temperature of from about 500 to about 750 F at a pressure of from atmospheric to 100 psig.

Stream 29 can be essentially all the remaining liquid from feed 5 less that which was vaporized in pre-heater 6 and is at a temperature of from about 500 to about 750 F at a pressure of from slightly above atmospheric up to about 100 psig (hereafter "atmospheric to 100 psig).

The combination of streams 28 and 42, as represented by stream 43, can be at a temperature of from about 650 to about 800 F at a pressure of from atmospheric to 100 psig, and contain, for example, an overall steam/hydrocarbon ratio of from about 0.2 to about 2 pounds of steam per pound of hydrocarbon.

Stream 45 can be at a temperature of from about 900 to about 1,100 F at a pressure of from atmospheric to 100 psig.

Stream 51 can be at a temperature of less than about 800 F, preferably less than about 700 F, and a pressure sufficient to inject the stream into a lower portion, section 54, of the interior of zone 30 below the lowest point of injection of stream 40 into section 54. By injecting stream 51 below stream 40 in zone 30, the temperature reduction (rapid quenching effect) of the liquid in section 54 is maximized.

Liquid residuum 50 can be comprised of a fraction, e.g., less than about 50 wt. % of feed 5, based on the total weight of feed 5, diluted with all, essentially all, or none of oil 51 or components thereof. Stream 50 can contain essentially only feed 5 components, or can be a mixture of feed 5 components with oil 51 or components thereof. Thus, stream 50 can be composed 100% of feed 5 components or any weight mixture of feed 5 components and quenching oil 51 (or components thereof) depending on the initial compositions of the feed 5 and oil 51 initially employed, and the operating conditions of unit 26. The feed 5 components present in residuum 50 can have a boiling point greater than about 1,000 F. Residuum 50 can be at a temperature of less than about 700 F at a pressure of from atmospheric to 100 psig.

In zone 30, a high dilution ratio (hot gas/liquid droplets) is desirable. However, dilution ratios will vary widely because the composition of whole crude oils varies widely. Generally, hot gas 41, e.g., steam, to hydrocarbon ratio at the top of zone 30 can be from about 0.2/1 to about 5/1, preferably from about 0.2/1 to about 1.2/1, more preferably from about 0.2/1 to about 1/1.

Steam is an example of a suitable hot gas introduced by way of line 40. Other materials can be present in the steam employed. Stream 7 can be that type of steam normally used in a conventional cracking plant. Such gases are preferably at a temperature sufficient to volatilize a substantial fraction of the liquid hydrocarbon 32 that enters zone 30. Generally, the gas entering zone 30 from conduit 40 will be at least about 800 F, preferably from about 800° F. to about 1,100° F. at from atmospheric to 100 psig. Such gases will, for sake of simplicity, hereafter be referred to in terms of steam alone.

Stream 42 can be a mixture of steam and hydrocarbon vapor (derived primarily from feed 5, and, possibly, some small amount from oil 51) that boiled at a temperature lower than about 1,100 F. This stream can be at a temperature of from about 600 to about 800 F at a pressure of from atmospheric to 100 psig.

Conventional distillation tower packing 34 provides surface area for the steam entering from line 41. Section 34 thus provides surface area for contacting down flowing liquid with up flowing steam 41 entering from line 40. The counter current flow within section 30 enables the heaviest (highest boiling point) liquids to be contacted at the highest steam to oil ratio and, at the same time, with the highest temperature steam. This creates the most efficient device and operation for vaporization of the heaviest portion of the heavier oil feed stocks thereby allowing for very high utilization of such feedstocks as vaporous feed to severe cracking section R. Thus, the more difficultly vaporized liquid droplets receive the full thermal intensity of the incoming steam at its hottest and at a very high ratio of steam dilution so that the possibility of vaporizing these tenacious materials is maximized.

The temperature range within unit 26, and particularly within zone 30, coupled with the residence time in section 30, can be that which essentially vaporizes most, at least about 90 wt. % of the liquid components in feed 5 with an atmospheric boiling point of about 1,000 F and lower, based on the total weight of feed 5. This way a significant portion of the liquid whole crude primary feed is converted into a gaseous hydrocarbon stream suitable as feed for introduction into section R.

It can be seen that steam from line 40 does not serve just as a diluent for partial pressure purposes as does diluent steam that may be introduced, for example, into conduit 5 (not shown). Rather, steam from line 40 provides not only a diluting function, but also additional vaporizing energy for the hydrocarbons that remain in the liquid state. This is accomplished with just sufficient energy to achieve vaporization of heavier hydrocarbon components and by controlling the energy input. For example, by using steam in line 40, substantial vaporization of feed 5 liquid is achieved with reduced coke formation in section 30. This, coupled with the coke formation quenching effect of oil 51, with or without flashing of components of oil 51, provides for minimization of coke formation in section 54 and in residuum 50. The very high steam dilution ratio and the highest temperature steam are thereby provided where they are needed most as liquid hydrocarbon droplets move progressively lower in zone 30. The liquid droplets that are not vaporized are quenched rapidly by oil 51.

Unit 26 of FIG. 2, instead of being a standalone unit outside furnace 2, can be physically contained within the interior of convection zone C so that zone 30 is wholly within the interior of furnace 2. Although total containment of unit 26 within a furnace may be desirable for various furnace design considerations, it is not required in order to achieve the benefits of this invention. Unit 26 could also be employed wholly or partially outside of the furnace and still be within the spirit of this invention. Combinations of wholly interior and wholly exterior placement of unit 26 with respect to furnace 2 will be obvious to those skilled in the art and also are within the scope of this invention.

The operation of unit 26 of this invention can serve to remove materials that cannot be cracked or vaporized, whether hydrocarbonaceous or not. Typical examples of such materials are metals, inorganic salts, unconverted asphaltenes, and the like. Such materials can be taken from the system by way of line 50.

EXAMPLE

A whole crude oil stream 5 from a storage tank characterized as Saharan Blend is fed directly into a convection section of a pyrolysis furnace 2 at ambient conditions of temperature and pressure. In this convection section this whole crude oil primary feed is preheated to about 650° F. at about 70 psig, and then passed into a vaporization unit 26 wherein hydrocarbon gases at about 650 F and 63 psig are separated from liquids in zone 27 of that unit. The separated gases are removed from zone 27 for transfer to the radiant section of the same furnace for severe cracking in a temperature range of 1,450° F. to 1,500° F. at the outlet of radiant coil 9.

The hydrocarbon liquid remaining from feed 5, after separation from accompanying hydrocarbon gases aforesaid, is transferred to lower section 30 and allowed to fall downwardly in that section toward the bottom thereof. Preheated steam 40 at about 1,100° F. is introduced near the bottom of zone 30 to give a steam to hydrocarbon ratio in section 54 of about 3.8/1. The falling liquid droplets are in counter current flow with the steam that is rising from the bottom of zone 30 toward the top thereof. With respect to the liquid falling downwardly in zone 30, the steam to liquid hydrocarbon ratio increases from the top to bottom of zone 30.

A mixture of steam and hydrocarbon vapor 42 at about 710 F is withdrawn from near the top of zone 30 and mixed with the gases earlier removed from zone 27 via line 28 to form a composite steam/hydrocarbon vapor stream containing about 0.4 pounds of steam per pound of hydrocarbon present. This composite stream is preheated in zone 44 to about 1,025 F at less than about 50 psig, and introduced into the radiant section R of furnace 2.

I claim:

1. A method which comprises:

(a) separating a heated whole crude oil feedstock into vaporous and liquid hydrocarbons in a unit that provides a vaporization function;

(b) transferring at least a portion of said vaporous hydrocarbons to a radiant heating section of a furnace to induce severe thermal cracking;

(c) retaining at least part of said liquid hydrocarbons in said unit;

(d) contacting said retained liquid hydrocarbons with at least one heated gas to form additional vaporous hydrocarbons for transfer to said radiant heating section of a furnace;

(e) introducing near the bottom of said unit at least one quenching oil to form an oil-liquid hydrocarbon mixture, said quenching oil being at a temperature sufficient to cool remaining liquid hydrocarbons to minimize coke-forming reactions; and (f) removing at least a portion of said oil-liquid hydrocarbon mixture from said unit; whereby the operation of said unit is driven toward said vaporization function.

2. In a method for operating an olefin production plant that employs a pyrolysis furnace to severely thermally crack hydrocarbon materials for the subsequent processing of said cracked materials in said plant, said furnace having in its interior at least a convection heating section and a separate radiant heating section, said radiant heating section being employed for said severe cracking, the improvement comprising providing whole crude oil as the primary feedstock to said furnace, preheating said feedstock to form a mixture of vaporous and liquid hydrocarbons, collecting said mixture in a vaporization unit, in said unit separating said vaporous hydrocarbons from said liquid hydrocarbons, passing said vaporous hydrocarbons to said radiant heating section, retaining said liquid hydrocarbons in said unit, introducing at least one heated gas into said unit to mix with said liquid hydrocarbons in said unit to dilute said liquid hydrocarbons and heat same to form additional vaporous hydrocarbons and leave remaining liquid hydrocarbons in said unit, removing said additional vaporous hydrocarbons to said radiant heating section, introducing into said unit at least one quenching oil to form a mixture of said quenching oil and said remaining liquid hydrocarbons in said unit, said quenching oil being at a temperature sufficient to cool said remaining liquid hydrocarbons to minimize any coke forming reactions present in said remaining liquid hydrocarbons, and removing from said unit at least part of said remaining liquid hydrocarbons, thereby driving the operation of said unit toward vaporization.

3. The method of claim 1 wherein said feedstock is heated to a temperature of from about 500 to about 750 F, said heated gas heats said liquid hydrocarbons to a temperature of from about 650 to about 1,100 F, and said quenching oil has a temperature of less than about 800 F.

4. The method of claim 1 wherein said quenching oil has a temperature of less than about 700 F.

5. The method of claim 1 wherein said quenching oil is a hydrocarbonaceous liquid at ambient conditions of temperature and pressure.

6. The method of claim 1 wherein said quenching oil has a viscosity materially less than said remaining liquid hydrocarbons and produces a quenching oil/remaining liquid hydrocarbon mixture having a viscosity materially below the viscosity of said remaining liquid hydrocarbons alone.

7. The method of claim 1 wherein said quenching oil is at least one selected from the group consisting of hydrocarbon cracking plant quench oil, whole crude oil, natural gas condensate, gas oil, diesel oil, and kerosene.

8. The method of claim 1 wherein said quenching oil has hydrocarbon components that flash to vapor when mixed with said remaining liquid hydrocarbons to aid in the cooling of said remaining liquid hydrocarbons, and said components that flash are operable as feed for cracking in said radiant heating section.

9. The method of claim 1 wherein said quenching oil is introduced into said unit below the lowest point of introduction into said unit of said at least one heated gas.

10. The method of claim 1 wherein said heated gas is mixed with at least one of said vaporous hydrocarbons and additional vaporous hydrocarbons after removal of same from said unit and before introduction of same into said radiant section.

11. The method of claim 1 wherein essentially all vaporous hydrocarbons are separated from said remaining liquid hydrocarbons so that primarily only hydrocarbon liquid retained in said unit is subjected to both higher heated gas to liquid hydrocarbon ratios and higher heated gas temperatures to cause additional vaporization of said liquid hydrocarbons.

12. The method of claim 1 wherein said heated gas is introduced into said unit at a heated gas/hydrocarbon dilution ratio of from about 0.2/1 to about 5/1.

13. The method of claim 1 wherein said heated gas is introduced into said unit at a temperature of at least about 800 F.

14. The method of claim 1 wherein said heated gas is steam.

15. The method of claim 2 wherein said unit is a) in the interior of said convection heating section or b) outside said furnace but in fluid communication with the interior of said furnace.

16. The method of claim 1 wherein said whole crude stream is crude oil that has not been subjected to any fractionation prior to its introduction into said furnace.

* * * * *